United States Patent [19]

Alaki et al.

[11] Patent Number: 4,681,323

[45] Date of Patent: Jul. 21, 1987

[54] GOLF BALL

[75] Inventors: Yasuhide Alaki, Saitama; Masayuki Ohtake, Yokohama; Keisuke Ihara, Tokyo, all of Japan

[73] Assignee: Bridgestone Corporation, Tokyo, Japan

[21] Appl. No.: 699,438

[22] Filed: Feb. 7, 1985

[30] Foreign Application Priority Data

Feb. 7, 1984 [JP] Japan ..... 59-20419

[51] Int. Cl.[4] ..... A63B 37/14; A63B 37/02

[52] U.S. Cl. ..... 273/232; 273/218; 273/227; 273/DIG. 22

[58] Field of Search ..... 273/232, 220, 218, 227

[56] References Cited

U.S. PATENT DOCUMENTS

| | | | |
|---|---|---|---|
| 878,254 | 2/1908 | Taylor | 273/232 |
| 4,090,716 | 5/1978 | Martin et al. | 273/232 |
| 4,142,727 | 3/1979 | Shaw et al. | 273/232 |

FOREIGN PATENT DOCUMENTS

| | | | |
|---|---|---|---|
| 925121 | 4/1973 | Canada | 273/232 |
| 4626 | 1/1979 | Japan | 273/232 |
| 2103939 | 3/1983 | United Kingdom | 273/232 |

OTHER PUBLICATIONS

"The Curious History of the Golf Ball, Mankind's Most Fascinating Sphere," Horizon Press, New York, pp. 126–130.

*Primary Examiner*—George J. Marlo

*Attorney, Agent, or Firm*—Birch, Stewart, Kolasch & Birch

[57] ABSTRACT

A golf ball with a plurality of recessed dimples having a shape in accordance with a certain mathematical ratio on the surface thereof is disclosed. The value of the spatial volume of each dimple below a plane defined by an edge of the dimple divided by the volume of a cylinder, wherein the bottom of the cylinder is defined by the plane and the height is determined by the maximum depth of the dimple from the plane, is within the range of 0.35 to 0.43. The dimples having such a shape represent at least 90 percent of the total number of dimples on the golf ball. The maximum diameter of the dimple can be within the range of 2 to 4 mm and the maximum depth of the dimple can be within the range of 0.1 to 0.4 mm. This configuration results in a golf ball having an increased carry.

10 Claims, 15 Drawing Figures

GOLF BALL

BACKGROUND OF THE INVENTION

This invention relates to a golf ball which has a large carry.

Conventionally, various examinations have been made to optimize an arrangement, number and size (diameter and/or depth), of dimples on a golf ball to increase the carry of a golf ball. The present inventors, however, have discovered that while such factors as the arrangement, number and size of dimples are significant factors which influence the carry of a golf ball, the sectional shape and spatial volume of a dimple are also significant.

In particular, as illustrated in FIG. 1, a golf ball 20 has a large number of recessed dimples 1 formed on the surface thereof. The shape of a dimple of such a prior art golf ball is, in most cases, a parabolic curve (FIG. 2), an ellipse (FIG. 3) or a sine curve (FIG. 4) or a flattened trapezoid. The present inventors have learned that since any of these sectional shapes sharply intrudes into the surface of the ball, the air resistance becomes aerodynamically greater in comparison with the dynamic lift and hence the ball cannot make best use of momentum initially imparted thereto, resulting in an insufficient carry of the ball. Thus, the sectional shapes of the prior art golf balls do not make sufficient use of the initial momentum.

SUMMARY OF THE INVENTION

It is an object of the present invention to provide a golf ball wherein the characteristics of dimples on the balls increase the carry of the golf ball.

After an extensive investigation in connection with developing a sectional shape and a spatial volume of a dimple on a golf ball in order to obtain a golf ball which results in an increased carry, the present inventors have discovered that dimples having such a shape that the value of the spatial volume of each dimple below a plane surrounded by an edge of the dimple divided by the volume of a cylinder wherein the bottom thereof is defined by the plane and the height is given by the maximum depth of the dimple from the plane is within the range from 0.35 to 0.43 are effective to increase the carry of a golf ball. The present inventors have also discovered that if a golf ball wherein dimples having this shape occupy at least 90 percent of the total number of the dimples on the ball, the carry increases in comparison with a golf ball having dimples having a conventional cross sectional shape.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A golf ball according to the present invention is characterized by the shape of its dimples and in that these dimples have such a shape that the value of the spatial volume of each dimple below a plane surrounded by an edge of the dimple divided by the volume of a cylinder wherein the bottom thereof is defined by the plane and the height is given by the maximum depth of the dimple from the plane is within the range from 0.35 to 0.43. The dimples have such a shape occupying at least 90 percent of the whole number of the dimples.

Figure 5:
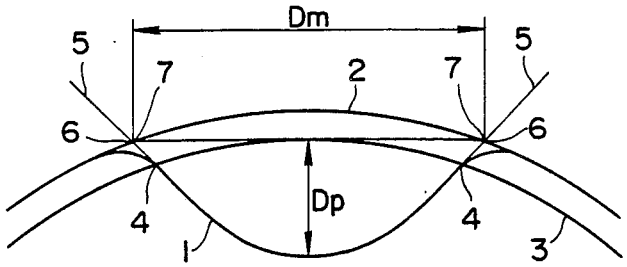
FIGS. 5 to 7 are diagrammatic representations illustrating how to calculate the spatial volume of a dimple and the volume of a cylinder.
Figure 6:
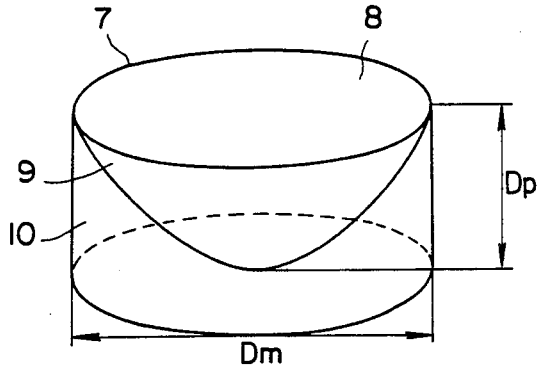
Figure 7:
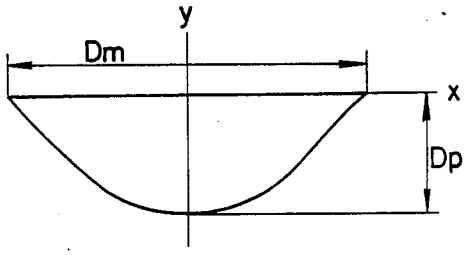

The shape of a dimple according to the present invention will be described more in detail. When the shape of a dimple in plan is a circle, an imaginary spherical face 2 of the diameter of the ball is drawn above a dimple 1 as illustrated in FIG. 5 while another spherical face 3 having a smaller diameter by (0.16 mm) than the ball diameter is also drawn, and cross points 4 between the spherical face 3 and the dimple 1 are found. Then, the line of cross points 6 between tangential lines 5 at the cross points 4 and the imaginary spherical face 2 is defined as a dimple edge 7. This definition of the dimple edge 7 is necessary because an accurate position of a dimple edge cannot be found without this definition since a marginal edge of a dimple 1 is normally a little rounded. Then, the first volume ($V_1$) of the dimple space 9 below the plane (a circle: a diameter Dm) 8 surrounded by the dimple edge 7 as illustrated in FIGS. 6 and 7 is calculated by the following equation:

$$V_1 = \int_0^{\frac{Dm}{2}} 2\pi xydx$$

Meanwhile, the volume $V_2$ of the cylinder 10 wherein the bottom thereof is defined by the plane 8 and the height is defined by the maximum dimple depth Dp from the plane 8 is calculated by the following equation:

$$V_2 = \frac{\pi Dm^2 Dp}{4}$$

Then, the ratio $V_o$ of the dimple volume $V_1$ to the cylinder volume $V_2$ is calculated by the following equation:

$$V_o = V_1/V_2$$

It is to be noted that when the shape of the dimple from a plan view is not a circle, the diameter is defined as a diameter whose area of circle is equal to that of the shape which is not a circle, so that $V_o$ is calculated in the same manner as described above.

A golf ball according to the present invention has dimples of such a shape that $V_o$ calculated in this manner has a value from 0.35 to 0.43, and more preferably from 0.37 to 0.41, and by using a golf ball wherein the dimples having $V_o$ from 0.35 to 0.43 represent not less than 90 percent, more preferably not less than 95 percent, and most preferably 100 percent of the whole dimples or the ball, so that the carry to the ball can be increased.

Figure 8:
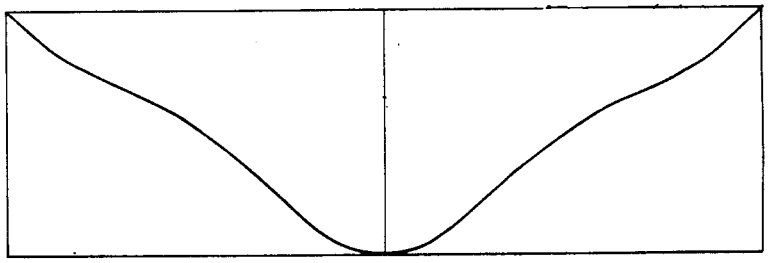
FIGS. 8 to 10 are cross sectional views showing different embodiments of a dimple configuration of a golf ball according to the present invention.
Figure 9:
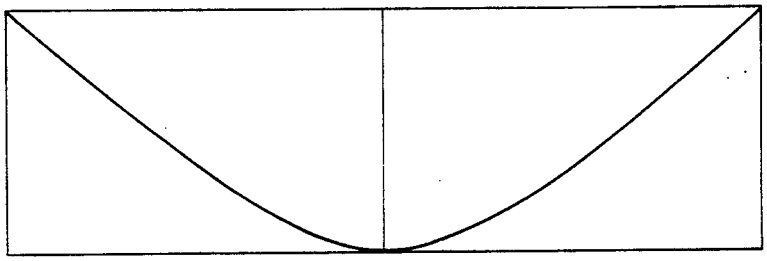
Figure 10:
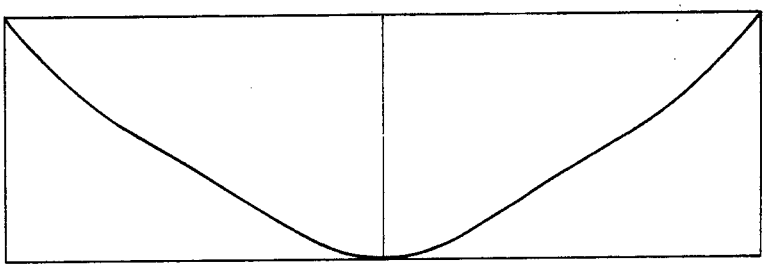

Different cross sectional shapes of dimples of golf balls according to the present invention are illustrated in FIGS. 8, 9 and 10, and $V_o$ of the cross sectional dimple shape is 0.35 in FIG. 8, 0.40 in FIG. 9 and 0.43 in FIG. 10.

Figure 1:
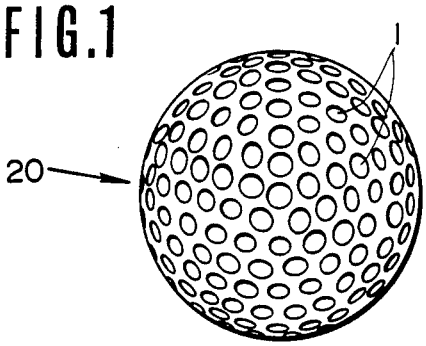
FIG. 1 is a plan view of a golf ball.
Figure 2:
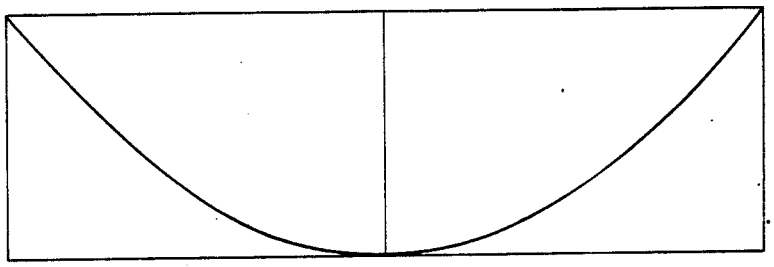
FIG.2 PRIOR ART
FIGS. 2 to 4 are each cross sectional views of the dimples of a conventional golf ball.
Figure 3:
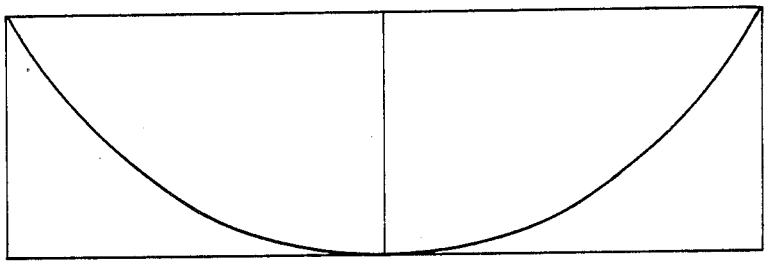
FIG.3 PRIOR ART
Figure 4:
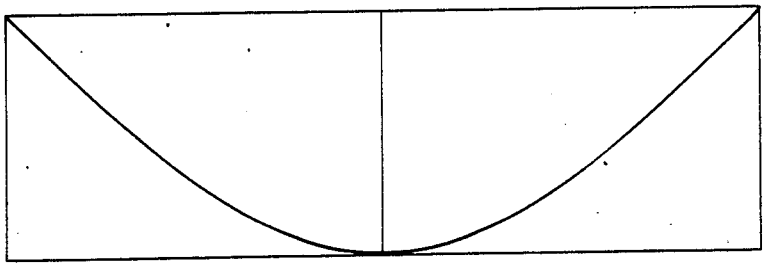
FIG.4 PRIOR ART

It should be noted that a value of $V_o$ of dimples of conventional golf balls is greater than 0.45, and particularly around 0.50. For example, $V_o$ of the dimple of a cross section of the parabolic curve of FIG. 2 is 0.50, $V_o$ of the dimple of the elliptic cross section of FIG. 3 is 0.52 and $V_o$ of the sinusoidal cross section of FIG. 4 is 0.46. While an inverted cone and an inverted pyramid may also be possible as the shape of conventional dimples, $V_o$ of such dimples is 0.33, and hence a golf ball having such dimples is inferior in carry to a ball according to the present invention.

A dimple shape according to the present invention is such that a depthwise intermediate portion of a circumferential wall of the dimple is rather thin compared with a conventional dimple shape having $V_o$ greater than 0.45 where the maximum diameter of the plane and the maximum depth are identical between both dimples.

According to the present invention, while the value of $V_o$ of dimples is within the range as described above, the shape of the dimple in plan is not limited to a particular certain one. For example, while a shape of a dimple in plan is preferably a circle, it can be any other shape such as a polygon or the like. Moreover, while the maximum diameter and the maximum depth of a dimple are not limited to a certain particular value, preferably the maximum diameter is 2 to 4 mm and the maximum depth is 0.1 to 0.4 mm.

In addition, a golf ball according to the present invention preferably has from 280 to 330 dimples. An arrangement of dimples may be any of conventional patterns, and a suitable arrangement such as, for example, a right icosahedron arrangement or a right dodecahedron arrangement may be employed. Preferably, dimples are distributed on the surface of the ball in accordance with such an arrangement.

Dimple shapes according to the present invention can be applied to any type of golf balls such as small balls having a diameter of not less than 41.15 mm and a weight of not more than 45.92 g and large balls having a diameter of not less than 42.67 mm and a weight of not more than 45.92 g and can increase the carry of a ball. Further, while the dimple shapes can be applied to balls of any construction and hence to two piece sold balls, thread-wound balls and so on, particularly where the dimple shapes are applied to two piece solid balls, the increase in carry is remarkable. Besides, while conventional two piece solid balls generally have a low initial spin and hence they hardly produce a sufficient dynamic lift, a sufficient dynamic lift can be obtained by a golf ball which employs dimples according to the present invention.

The present invention makes it possible to reduce the problem a two piece solid golf ball experiences with regard to trajectory, i.e., its tendency to "drop" due to a small "lift".

The present invention will now be described more particularly in connection with the examples and comparative examples illustrated in the drawings, but it is to be noted that the present invention is not limited to those specific examples as described below.

EXAMPLES AND COMPARATIVE EXAMPLES

Two piece solid balls (large size) having dimples of a circular shape in plan as indicated in Table 1, and ionomer cover thread-wound balls (large size) having dimples as indicated in Table 1 were produced as mentioned below, and using a hitting robot produced by True Temper Company, hitting tests were performed to evaluate the carries of the balls. It should be noted that the dimples were distributed uniformly over the entire surface of any ball.

| Two piece solid ball | |
|---|---|
| Core | |
| Formulation: | |
| Cis-1,4-polybutadiene rubber | 100 parts by weight |
| Zinc dimethacrylate | 30 parts by weight |
| Zinc oxide | 18 parts by weight |
| Dicumyl peroxide | 2.5 parts by weight |
| Diameter: 38.1 mm | |
| Weight: 33.5 g | |
| Cover | |
| Formulation: | |
| Surlyn ® 1707 which is a trade name and sold by Du pont of the U.S.A. | 100 parts by weight |
| Titanium dioxide | 1 parts by weight |
| Thickness: 2.3 mm | |

The core composition was vulcanized for 30 minutes at 160° C. in a mold to produce a solid core. Then the solid core was covered with the cover composition, followed by press molding for 2 minutes at 170° C. in a mold to obtain a two piece solid ball having a diameter of 42.7 mm, a weight of 45.2 g and a hardness (PGA compression) of 100.

| Thread-wound ball | |
|---|---|
| Center | |
| Formulation: | |
| Cis-1,4-polybutadiene rubber | 100 parts by weight |
| Sulfur | 5 parts by weight |
| Zinc oxide | 10 parts by weight |
| Barium sulfate | 68 parts by weight |
| Vulcanization accelerator | 1 parts by weight |
| Accelerator aid | 3 parts by weight |
| Diameter: 30.0 mm | |
| Weight: 20.0 g | |
| Rubber thread | |
| Formulation: | |
| Cis-1,4-polyisoprene rubber | 100 parts by weight |
| Sulfur | 1 parts by weight |
| Zinc oxide | 0.6 parts by weight |
| Vulcanization accelerator | 1.5 parts by weight |
| Accelerator aid | 1 parts by weight |
| Cover | |
| Formulation: | |
| Surlyn ® 1557 which is a trade name and solid by Du pont of the U.S.A. | 100 parts by weight |
| Titanium oxide | 1 parts by weight |
| Thickness: 2.0 mm | |

The center composition was vulcanized for 20 minutes at 150° C. and the rubber thread composition was vulcanized for 40 minutes at 150° C. Then the center was wound with the rubber thread and thereafter covered with the cover composition, followed by press molding for 10 minutes at 160° C. to obtain an ionomer cover thread-wound ball having a diameter of 42.7 mm, a weight of 45.2 g and a hardness (PGA compression) of 90.

Figure 13:
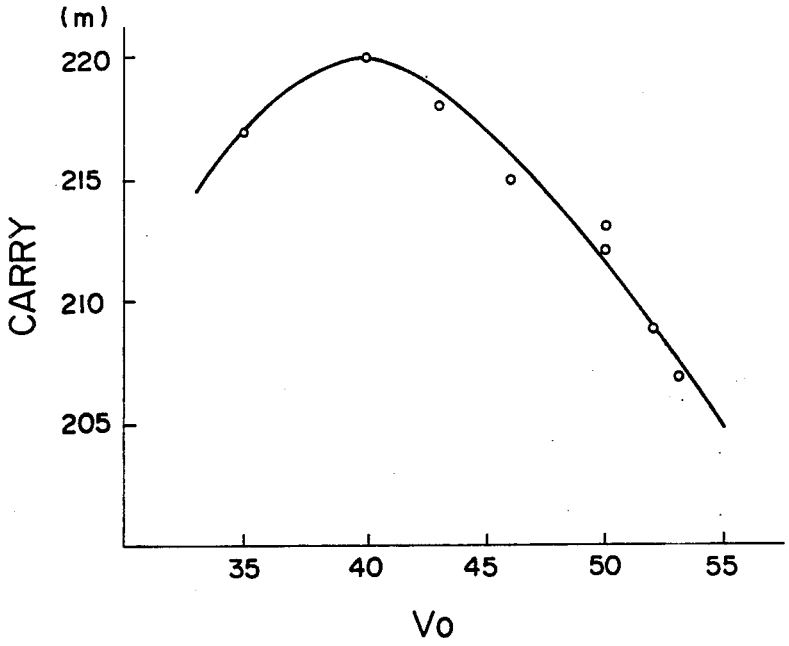
FIG. 13 is a graph illustrating the carry when two piece solid balls having dimples of different shapes are hit.
Figure 14:
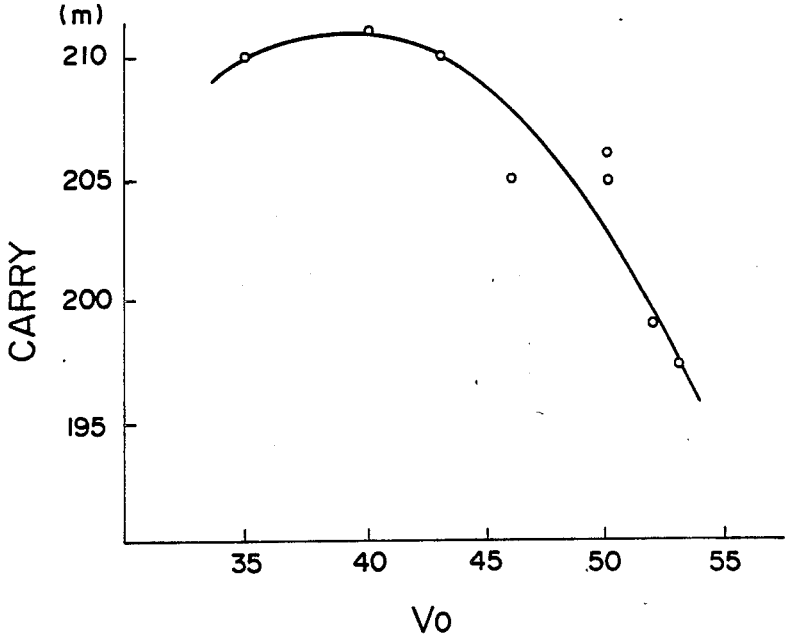
FIG. 14 is a graph illustrating the carry wherein thread-wound balls having dimples of different shapes are hit.

Results of the tests of the two piece solid balls are indicated in Table 2 and in FIG. 13 while results of the tests of the thread-wound balls are indicated in Table 2 and in FIG. 14.

It should be noted that the results of carries are average values of the results of 20 hits.

TABLE 1

Dimple Construction of Solid Two Piece and Thread Wound Balls

Figure 11:
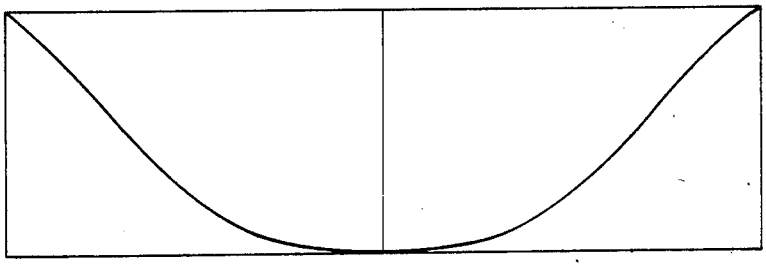
FIGS. 11 and 12 are cross sectional views of dimples of different golf balls of comparative examples.
Figure 12:
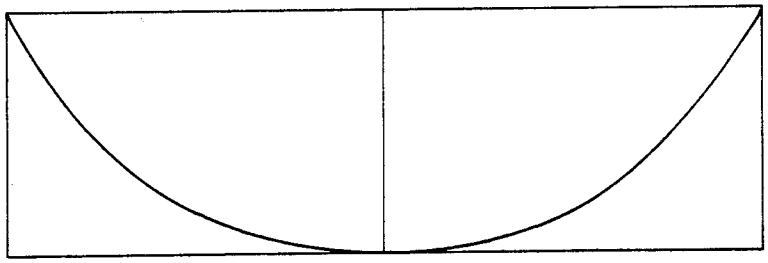

| | Dimple | | | | | |
|---|---|---|---|---|---|---|
| No. | Number | Diameter (mm) | Depth (mm) | $V_o$ | Cross Sectional Shape | |
| 1 | 318 | 3.84 | 0.24 | 0.35 | FIG. 8 | Example |
| 2 | 318 | 3.83 | 0.23 | 0.40 | FIG. 9 | Example |
| 3 | 318 | 3.76 | 0.25 | 0.43 | FIG. 10 | Example |
| 4 | 318 | 3.52 | 0.25 | 0.50 | FIG. 11 | Comparative Example |
| 5 | 318 | 3.73 | 0.24 | 0.53 | FIG. 12 | Comparative Example |
| 6 | 318 | 3.75 | 0.24 | 0.50 | FIG. 2 | Prior Art |
| 7 | 318 | 3.75 | 0.24 | 0.52 | FIG. 3 | Prior Art |
| 8 | 318 | 3.75 | 0.24 | 0.46 | FIG. 4 | Prior Art |

Figure 15:
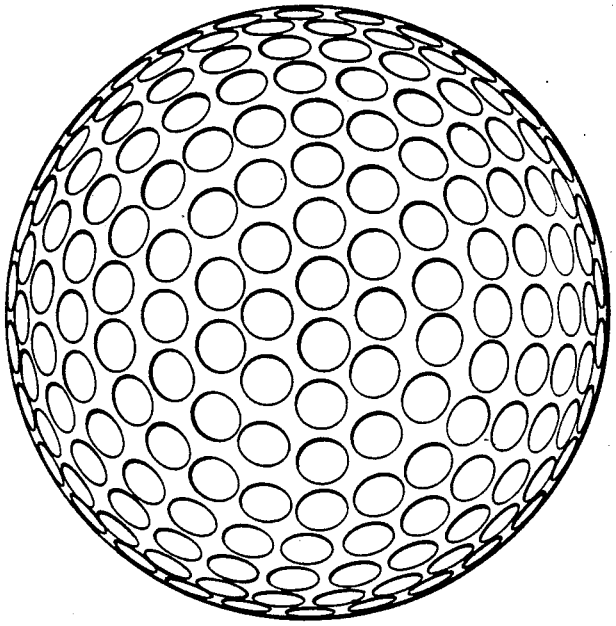

The arrangement of the dimples is shown in FIG. 15.

TABLE 2

| | | Results | | |
|---|---|---|---|---|
| No. | $V_o$ | Two Solid Piece Ball Carry (m) | Thread-wound Ball Carry (m) | |
| 1 | 0.35 | 217 | 210 | Example |
| 2 | 0.40 | 220 | 211 | Example |
| 3 | 0.43 | 218 | 210 | Example |
| 4 | 0.50 | 213 | 206 | Comparative Example |
| 5 | 0.53 | 207 | 197 | Comparative Example |
| 6 | 0.50 | 212 | 205 | Prior Art |
| 7 | 0.52 | 209 | 199 | Prior Art |
| 8 | 0.46 | 215 | 205 | Prior Art |

From those results, it can be seen that a golf ball having dimples wherein $V_o$ ranges from 0.35 to 0.43 provides a sufficiently large carry.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf ball having a plurality of recessed dimples on the surface thereof, wherein said dimples have a shape wherein the value of the spatial volume of each dimple below a plane defined by an edge of the dimple divided by the volume of a cylinder wherein the bottom of said cylinder is defined by said plane and the height is determined by the maximum depth of the dimple from said plane, is within the range from 0.35 to 0.43, wherein the maximum diameter of the dimple is within the range of 2–4 mm and the maximum depth of the dimple is within the range of 0.1–0.4 mm, said dimples representing at least 90 percent of the total number of dimples on said golf ball.

2. A golf ball according to claim 1 wherein the value of the spatial volume of the dimple divided by the volume of the cylinder, is within the range from 0.37 to 0.41.

3. A golf ball according to claim 1 wherein the shape of the dimple in plan is a circle.

4. A golf ball according to claim 1 wherein the total number of the dimples is within the range from 280 to 330.

5. A golf ball according to claim 1 wherein the golf ball is a two piece solid ball.

6. A golf ball having a plurality of recessed dimples which in plan view have a circular shape, wherein the value of $V_0$ of said dimples ranges from 0.35 to 0.43, wherein $V_0$ is determined by the method comprising the steps of:

drawing an imaginary spherical face 2 of the diameter of the ball above a dimple 1 as illustrated in FIGS. 5 and 6;

drawing another spherical face 3 having a smaller diameter by 0.16 mm then the ball diameter;

determining cross points 4 between the spherical face 3 and the dimple 1;

drawing a line of cross points 6 between tangential lines 5 at the cross points 4 and the imaginary spherical face 2 to define a define a dimple edge 7;

calculating a first volume $V_1$ of a dimple space 9 below a plane 8 defined by the dimple edge 7 by the following equation:

$$V_1 = \int_0^{\frac{Dm}{2}} 2\pi xydx;$$

calculating a volume $V_2$ of a cylinder 10 wherein the bottom thereof is defined by the plane 8 and the height is defined by the maximum dimple depth Dp from the plane 8 by the following equation:

$$V_2 = \frac{\pi Dm^2 Dp}{4};$$

and calculating $V_0$ by the following equation:

$$V_0 = V_1/V_2,$$

said dimples representing at least 90% of the total number of dimples on said golf ball.

7. The golf ball according to claim 6, wherein $V_0$ ranges from 0.37 to 0.41.

8. The golf ball according to claim 6, wherein the maximum diameter of the dimple ranges from 2 to 4 mm and the maximum depth of the dimple ranges from 0.1 to 0.4 mm.

9. The golf ball according to claim 6, wherein the total number of dimples ranges from 280 to 300.

10. The golf ball according to claim 6, wherein the golf ball is a two piece solid ball.

* * * * *